US010632529B2

(12) United States Patent
Crewdson et al.

(10) Patent No.: US 10,632,529 B2
(45) Date of Patent: Apr. 28, 2020

(54) DURABLE ELECTRODES FOR RAPID DISCHARGE HEATING AND FORMING OF METALLIC GLASSES

(71) Applicant: Glassimetal Technology, Inc., Pasadena, CA (US)

(72) Inventors: Chase Crewdson, Los Angeles, CA (US); Joseph P. Schramm, Sierra Madre, CA (US); Marios D. Demetriou, West Hollywood, CA (US); William L. Johnson, San Marino, CA (US)

(73) Assignee: Glassimetal Technology, Inc., Pasadena, CA (US)

( * ) Notice: Subject to any disclaimer, the term of this patent is extended or adjusted under 35 U.S.C. 154(b) by 197 days.

(21) Appl. No.: 15/694,298

(22) Filed: Sep. 1, 2017

(65) Prior Publication Data

US 2018/0065173 A1 Mar. 8, 2018

Related U.S. Application Data

(60) Provisional application No. 62/383,714, filed on Sep. 6, 2016.

(51) Int. Cl.

| | |
|---|---|
| ***B22D 25/06*** | (2006.01) |
| ***B22D 17/20*** | (2006.01) |
| *C22C 45/00* | (2006.01) |

(52) U.S. Cl.

CPC ..... *B22D 17/2038* (2013.01); *B22D 25/06* (2013.01); *C22C 45/00* (2013.01)

(58) Field of Classification Search

None

See application file for complete search history.

(56) References Cited

U.S. PATENT DOCUMENTS

| | | | |
|---|---|---|---|
| 2,467,782 | A | 12/1947 | Schuman |
| 2,587,175 | A | 2/1952 | Lapping |

(Continued)

FOREIGN PATENT DOCUMENTS

| | | |
|---|---|---|
| CN | 1552940 | 12/2004 |
| CN | 1689733 | 11/2005 |

(Continued)

OTHER PUBLICATIONS

Demetriou, Document cited and published during Applicant Interview Summary conducted on Jan. 29, 2013, entitled, "Rapid Discharge Heating & Forming of Metallic Glasses: Concepts, Principles, and Capabilities," Marios Demetriou, 20 pages.

(Continued)

*Primary Examiner* — George Wyszomierski

(74) *Attorney, Agent, or Firm* — KPPB LLP

(57) ABSTRACT

A rapid discharge heating and forming apparatus is provided. The apparatus includes a source of electrical energy and at least two electrodes configured to interconnect the source of electrical energy to a metallic glass sample. The apparatus also includes a shaping tool disposed in forming relation to the metallic glass sample. The source of electrical energy and the at least two electrodes are configured to deliver a quantum of electrical energy to the metallic glass sample to heat the metallic glass sample. The shaping tool is configured to apply a deformational force to shape the heated sample to an article. The at least two electrodes have a yield strength of at least 200 MPa, a Young's modulus that is at least 25% higher than the metallic glass sample, and an electrical resistivity that is lower than the metallic glass sample by a factor of at least 3.

19 Claims, 5 Drawing Sheets

(56) References Cited

U.S. PATENT DOCUMENTS 2,816,034 A 12/1957 Mittelmann
3,241,956 A 3/1966 Inoue
3,250,892 A 5/1966 Inoue
3,332,747 A 7/1967 Bundy
3,537,045 A 10/1970 Ichiro
3,863,700 A 2/1975 Bedell et al.
4,115,682 A 9/1978 Kavesh et al.
4,355,221 A 10/1982 Lin
4,462,092 A 7/1984 Kawabuchi et al.
4,523,748 A 6/1985 Latter
4,571,414 A 2/1986 Renlund et al.
4,715,906 A 12/1987 Taub et al.
4,809,411 A 3/1989 Lin et al.
4,950,337 A 8/1990 Li et al.
5,005,456 A 4/1991 Ballard et al.
5,069,428 A 12/1991 Li et al.
5,075,051 A 12/1991 Ito et al.
5,101,186 A 3/1992 Durum
5,196,264 A 3/1993 Tsuchiya et al.
5,220,349 A 6/1993 Saita et al.
5,278,377 A 1/1994 Tsai
5,288,344 A 2/1994 Peker et al.
5,324,368 A 6/1994 Masumoto et al.
5,368,659 A 11/1994 Peker et al.
5,427,660 A 6/1995 Kamimura et al.
5,550,857 A 8/1996 Richards
5,554,838 A 9/1996 Berdich
5,618,359 A 4/1997 Lin et al.
5,735,975 A 4/1998 Lin et al.
5,896,642 A 4/1999 Peker et al.
6,027,586 A 2/2000 Masumoto et al.
6,235,381 B1 5/2001 Sanders et al.
6,258,183 B1 7/2001 Onuki et al.
6,279,346 B1 8/2001 Ribes et al.
6,293,155 B1 9/2001 Babiel
6,355,361 B1 3/2002 Ueno et al.
6,432,350 B1 8/2002 Seres et al.
6,631,752 B2 10/2003 McDonald
6,771,490 B2 8/2004 Peker et al.
6,875,293 B2 4/2005 Peker
7,120,185 B1 10/2006 Richards
7,347,967 B2 3/2008 Kim et al.
7,506,566 B2 3/2009 Decristofaro et al.
7,883,592 B2 2/2011 Hofmann et al.
8,099,982 B2 1/2012 Takagi et al.
8,276,426 B2 10/2012 Musat et al.
8,499,598 B2 8/2013 Johnson et al.
8,613,813 B2 12/2013 Johnson et al.
8,613,814 B2 12/2013 Kaltenboeck et al.
8,613,815 B2 12/2013 Johnson et al.
8,613,816 B2 12/2013 Kaltenboeck et al.
8,776,566 B2 7/2014 Johnson et al.
8,961,716 B2 2/2015 Demetriou et al.
9,044,800 B2 6/2015 Johnson et al.
9,067,258 B2 6/2015 Schramm et al.
9,297,058 B2 3/2016 Demetriou et al.
9,309,580 B2 4/2016 Schramm et al.
9,393,612 B2 7/2016 Schramm et al.
9,463,498 B2 * 10/2016 Johnson ..... B21C 37/02
9,539,628 B2 * 1/2017 Poole ..... B21B 45/004
9,845,523 B2 12/2017 Schramm et al.
10,213,822 B2 2/2019 Lee et al.
10,248,004 B2 * 4/2019 Dussauze ..... G02F 1/3555
10,273,568 B2 4/2019 Lee et al.
2001/0033304 A1 10/2001 Ishinaga et al.
2002/0100573 A1 8/2002 Inoue et al.
2002/0122985 A1 9/2002 Sato et al.
2003/0056562 A1 3/2003 Kamano
2003/0183310 A1 10/2003 McRae
2003/0222122 A1 12/2003 Johnson et al.
2004/0035502 A1 2/2004 Kang et al.
2004/0067369 A1 4/2004 Ott et al.
2005/0034787 A1 2/2005 Song et al.
2005/0103271 A1 5/2005 Watanabe et al.
2005/0202656 A1 9/2005 Ito et al.
2005/0217333 A1 10/2005 Daehn
2005/0236071 A1 10/2005 Koshiba et al.
2005/0263216 A1 12/2005 Chin et al.
2006/0102315 A1 5/2006 Lee et al.
2006/0293162 A1 12/2006 Ellison
2007/0003782 A1 1/2007 Collier
2007/0023401 A1 2/2007 Tsukamoto et al.
2007/0034304 A1 2/2007 Inoue et al.
2008/0081213 A1 4/2008 Ito et al.
2008/0110864 A1 5/2008 Oussalem
2008/0135138 A1 6/2008 Duan et al.
2008/0302775 A1 12/2008 Machrowicz
2009/0236017 A1 9/2009 Johnson et al.
2009/0246070 A1 10/2009 Tokuda et al.
2010/0009212 A1 1/2010 Utsunomiya et al.
2010/0047376 A1 2/2010 Imbeau et al.
2010/0121471 A1 5/2010 Higo et al.
2010/0243618 A1 9/2010 Shibagaki et al.
2010/0320195 A1 12/2010 Fujita et al.
2011/0048587 A1 3/2011 Vecchio et al.
2012/0006085 A1 1/2012 Johnson et al.
2012/0103478 A1 5/2012 Johnson et al.
2012/0132625 A1 5/2012 Kaltenboeck et al.
2012/0255338 A1 10/2012 Johnson et al.
2012/0268079 A1 10/2012 Nakamura
2013/0001222 A1 1/2013 Kaltenboeck et al.
2013/0025814 A1 1/2013 Demetriou et al.
2013/0048152 A1 2/2013 Na et al.
2013/0112321 A1 * 5/2013 Poole ..... B21B 45/004
148/241
2013/0319062 A1 12/2013 Johnson et al.
2014/0033787 A1 2/2014 Johnson et al.
2014/0045680 A1 * 2/2014 Nakayama ..... C22C 45/00
502/100
2014/0047888 A1 2/2014 Johnson et al.
2014/0083150 A1 3/2014 Kaltenboeck et al.
2014/0102163 A1 4/2014 Kaltenboeck et al.
2014/0130563 A1 5/2014 Lee et al.
2014/0283956 A1 9/2014 Schramm et al.
2015/0090375 A1 4/2015 Lee et al.
2015/0096967 A1 4/2015 Lee et al.
2015/0231675 A1 8/2015 Johnson et al.
2015/0299825 A1 10/2015 Prest et al.
2015/0367410 A1 12/2015 Schramm et al.
2016/0008870 A1 * 1/2016 Schramm ..... B21J 1/006
72/342.96
2016/0298205 A1 10/2016 Johnson et al.
2017/0203358 A1 7/2017 Schramm et al.

FOREIGN PATENT DOCUMENTS

CN 101053281 10/2007
CN 201838352 5/2011
CN 103320783 9/2013
EP 0921880 6/1999
EP 2556178 2/2013
FR 2806019 9/2001
GB 215522 5/1924
GB 2148751 6/1985
JP 48-008694 3/1973
JP 63-220950 9/1988
JP H06-57309 3/1994
JP H06-277820 10/1994
JP H 08-024969 1/1996
JP 08-300126 11/1996
JP 10-263739 10/1998
JP 10-296424 11/1998
JP 11-001729 1/1999
JP 11-104810 4/1999
JP 11-123520 11/1999
JP 11-354319 12/1999
JP 2000-119826 4/2000
JP 2000-169947 6/2000
JP 2001-321847 11/2001
JP 2001-347355 12/2001
JP 2003-509221 3/2003
JP 2005-209592 8/2005
JP 2008-000783 1/2008
JP 2011-517623 6/2011

(56) References Cited

FOREIGN PATENT DOCUMENTS

| | | |
|---|---|---|
| JP | 2013-530045 | 7/2013 |
| KR | 10-0271356 | 11/2000 |
| WO | WO 01/21343 | 3/2001 |
| WO | WO 2009/048865 | 4/2009 |
| WO | WO 09/117735 | 9/2009 |
| WO | WO 11/127414 | 10/2011 |
| WO | WO 12/051443 | 4/2012 |
| WO | WO 12/092208 | 7/2012 |
| WO | WO 12/103552 | 8/2012 |
| WO | WO 12/112656 | 8/2012 |
| WO | WO 2014/078697 | 5/2014 |

OTHER PUBLICATIONS

De Oliveira et al., "Electromechanical engraving and writing on bulk metallic glasses", Applied Physics Letters, Aug. 26, 2002, vol. 81, No. 9, pp. 1606-1608.

Duan et al., "Bulk Metallic Glass with Benchmark Thermoplastic Processability", Adv. Mater., 2007, vol. 19, pp. 4272-4275.

Ehrt et al., "Electrical conductivity and viscosity of borosilicate glasses and melts," Phys. Chem. Glasses: Eur. J. Glass Sci. Technol. B, Jun. 2009, 50(3), pp. 165-171.

Love, "Temperature dependence of electrical conductivity and the probability density function," J. Phys. C: Solid State Phys., 16, 1983, pp. 5985-5993.

Mattern et al., "Structural behavior and glass transition of bulk metallic glasses," Journal of Non-Crystalline Solids, 345&346, 2004, pp. 758-761.

Wiest et al., "Zi—Ti-based Be-bearing glasses optimized for high thermal stability and thermoplastic formability", Acta Materialia, 2008, vol. 56, pp. 2625-2630.

Yavari et al., "Electromechanical shaping, assembly and engraving of bulk metallic glasses", Materials Science and Engineering A, 2004, vol. 375-377, pp. 227-234.

Yavari et al., "Shaping of Bulk Metallic Glasses by Simultaneous Application of Electrical Current and Low Stress", Mat. Res. Soc. Symp. Proc., 2001, vol. 644, pp. L12.20.1-L12.20.6.

Saotome et al., "Characteristic behavior of Pt-based metallic glass under rapid heating and its application to microforming," *Materials Science and Engineering A*, 2004, vol. 375-377, pp. 389-393.

Kulik et al., "Effect of flash- and furnace annealing on the magnetic and mechanical properties of metallic glasses," *Materials Science and Engineering*, A133 (1991), pp. 232-235.

Masuhr et al., Time Scales for Viscous Flow, Atomic Transport, and Crystallization in the Liquid and Supercooled Liquid States of Zr41.2Ti13.8Cu12.5Ni10.0Be22.5,: *Phys. Rev. Lett.*, vol. 82, (1999), pp. 2290-2293.

Schroers et al., "Pronounced asymmetry in the crystallization behavior during constant heating and cooling of a bulk metallic glass-forming liquid," Phys. Rev. B, vol. 60, No. 17 (1999), pp. 11855-11858.

Johnson et al., "A Universal Criterion for Plastic Yielding of Metallic Glasses with a $(T/T_g)^{frac;2;3}$Temperature Dependence," Physical Review Letter, (2005), PRL 95, pp. 195501-195501-4.

* cited by examiner

DURABLE ELECTRODES FOR RAPID DISCHARGE HEATING AND FORMING OF METALLIC GLASSES

CROSS-REFERENCE TO RELATED PATENT APPLICATION

This patent application claims the benefit of U.S. Patent Application No. 62/383,714, entitled "DURABLE ELECTRODES FOR RAPID DISCHARGE HEATING AND FORMING OF METALLIC GLASSES," filed on Sep. 6, 2016 under 35 U.S.C. § 119(e), which is incorporated herein by reference in its entirety.

FIELD

The disclosure is directed to durable electrodes to be used in rapid discharge heating and forming (RDHF) techniques for shaping metallic glasses.

BACKGROUND

U.S. Pat. No. 8,613,813 entitled "Forming of Metallic Glass by Rapid Capacitor Discharge" is directed, in certain aspects, to a rapid discharge heating and forming method (RDHF method), in which a metallic glass is rapidly heated and formed into an amorphous article by discharging a quantum of electrical energy through a metallic glass sample to rapidly heat the sample to a process temperature in the range between the glass transition temperature of the metallic glass and the equilibrium liquidus temperature of the metallic glass-forming alloy (termed the "undercooled liquid region"), shaping, and then cooling the sample to form an amorphous article. The above reference is incorporated herein by reference in its entirety.

U.S. Pat. No. 8,613,813 is also directed, in certain aspects, to a rapid discharge heating and forming apparatus (RDHF apparatus), which comprises a metallic glass feedstock, a source of electrical energy, at least two electrodes interconnecting the source of electrical energy to the metallic glass feedstock, where the electrodes are attached to the feedstock such that electrical connections are formed between the electrodes and the feedstock, and a shaping tool disposed in forming relation to the feedstock. In the disclosed apparatus, the source of electrical energy is configured to produce a quantum of electrical energy sufficient to heat the metallic glass sample to a processing temperature between the glass transition temperature of the metallic glass and the equilibrium liquidus temperature of the metallic glass forming alloy, while the shaping tool is configured to apply a deformational force to form the heated sample to a net shape article. In some embodiments, the source of electrical energy is configured to produce a quantum of electrical energy to heat the entirety of the sample to the processing temperature.

With respect to the electrode material, U.S. Pat. No. 8,613,813 discloses that in some embodiments the electrodes are made of a soft (i.e. low yield strength) highly-conductive metal such that when a uniform pressure is applied at the contact interface between the soft electrode and the harder metallic glass sample, any non-contact regions at the interface are plastically deformed at the electrode side of the interface, thereby improving electrical contact and reducing the electrical contact resistance. Specifically, U.S. Pat. No. 8,613,813 discloses that the electrode material is chosen to be a metal with low yield strength and high electrical and thermal conductivities, for example, copper, silver or nickel, or alloys formed with at least 95 at % of copper, silver or nickel. However, electrodes made of soft and low yield strength metals may have limited mechanical stability under typical rapid discharge heating and forming (RDHF) loads and also limited life after being repeatedly used. Therefore, there is a need for alternative electrode materials that promote good contact with the metallic glass sample leading to low electrical contact resistance, while being stable and durable under heavy loads.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

BRIEF SUMMARY

Figure 1:
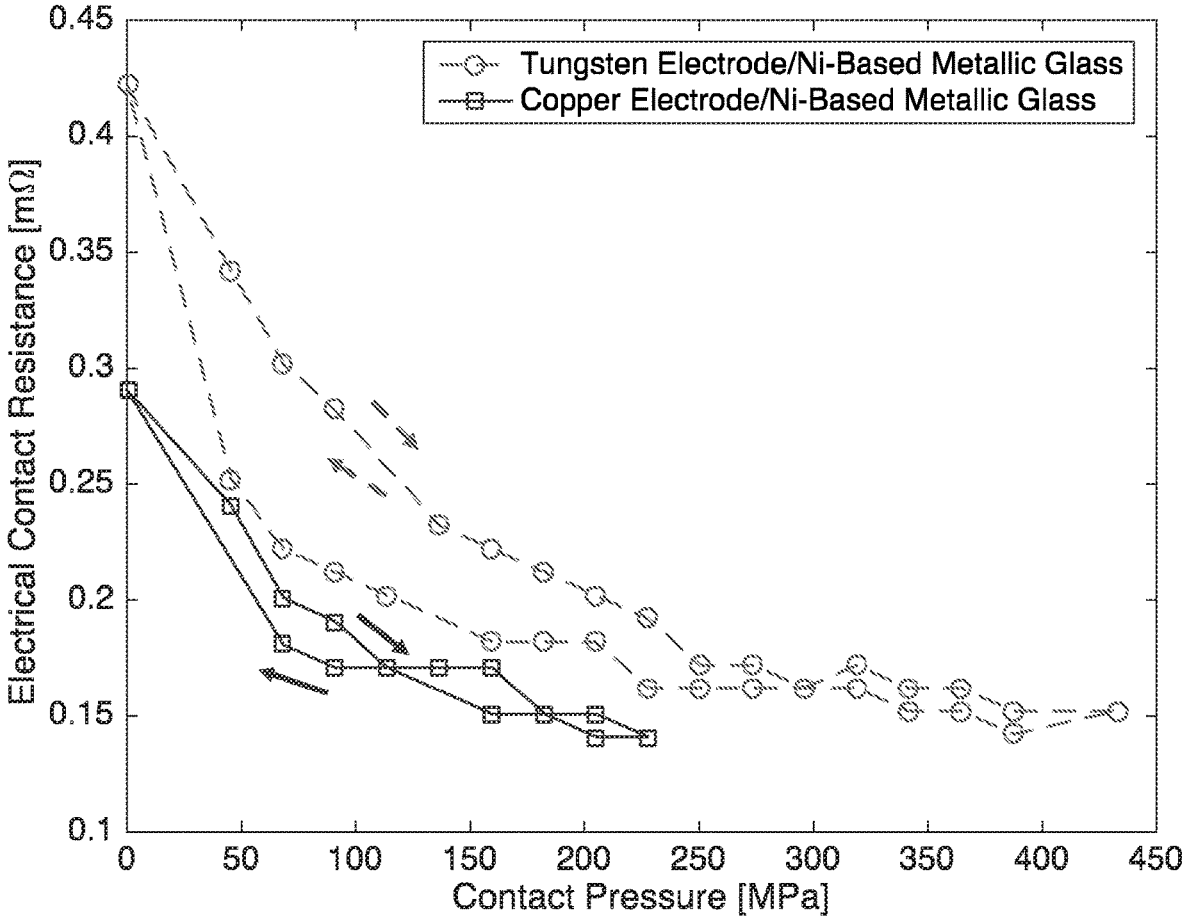
FIG. 1 presents a plot of the electrical contact resistance vs. contact pressure for an RCDF loading cycle of a tungsten electrode/$Ni_{68.17}Cr_{8.65}Nb_{2.98}P_{16.42}B_{3.28}Si_{0.5}$ metallic glass pair and an RCDF loading cycle of a copper electrode/$Ni_{68.17}Cr_{8.65}Nb_{2.98}P_{16.42}B_{3.28}Si_{0.5}$ metallic glass pair in accordance with embodiments of the disclosure.

The disclosure is directed to an RDHF apparatus.

In one aspect, a rapid discharge heating and forming apparatus is provided. The rapid discharge heating and forming apparatus includes a source of electrical energy The source of electric energy can be configured to deliver a quantum of electrical energy. The apparatus further includes at least two electrodes electrically connected to the source of electric energy and configured to electrically connect a metallic glass sample to the source of electrical energy when the metallic glass sample is in contact with each of said electrode. A shaping tool is disposed configured to be in forming relation to the metallic glass sample when the metallic glass sample is electrically connected to the two electrodes. One or both of the electrodes have a yield strength of at least 200 MPa, a Young's modulus at least 100 GPa, and an electrical resistivity equal to or less than 40 μΩ·cm. The electrodes can be configured to interconnect the source of electrical energy to a metallic glass sample. The apparatus can also include a shaping tool that can be configured in forming relation to the metallic glass sample.

In another aspect, a rapid discharge heating and forming apparatus is provided. The rapid discharge heating and forming apparatus can include a source of electrical energy. The source of electric energy can be configured to deliver a quantum of electrical energy. The apparatus further includes at least two electrodes electrically connected to the source of electric energy. One or both of the electrodes have a yield strength of at least 200 MPa, a Young's modulus at least 100 GPa, and an electrical resistivity equal to or less than 40 μΩ·cm. The electrodes can be configured to interconnect the source of electrical energy to a metallic glass sample. The apparatus can also include a shaping tool that can be configured in forming relation to the metallic glass sample.

In another aspect, the apparatus includes a source of electrical energy and at least two electrodes configured to interconnect the source of electrical energy to a metallic glass sample. The apparatus also includes a shaping tool disposed in forming relation to the metallic glass sample. The source of electrical energy and the at least two electrodes are configured to deliver a quantum of electrical energy to the metallic glass sample to heat the metallic glass sample. The shaping tool is configured to apply a deformational force to shape the heated sample to an article. The at least two electrodes have a yield strength of at least 200 MPa, a Young's modulus that is at least 25% higher than the metallic glass sample, and an electrical resistivity that is lower than the metallic glass sample by a factor of at least 3.

In another aspect, the electrodes have a yield strength of at least 300 MPa.

In another aspect, the electrodes have a yield strength of at least 400 MPa.

In another aspect, the electrodes have a yield strength of at least 500 MPa.

In other aspects, the electrodes are configured to apply a contact pressure at the contact interface between the electrodes and the metallic glass sample, and where the yield strength of the electrodes is higher than the applied contact pressure.

In another aspect, the electrodes have a Young's modulus that is at least 50% higher than the Young's modulus of the metallic glass sample.

In another aspect, the electrodes have a Young's modulus that is at least 75% higher than the Young's modulus of the metallic glass sample.

In another aspect, the electrodes have a Young's modulus that is at least 100% higher than the Young's modulus of the metallic glass sample.

In another aspect, the electrodes have a Young's modulus of at least 100 GPa.

In another aspect, the electrodes have a Young's modulus of at least 150 GPa.

In another aspect, the electrodes have a Young's modulus of at least 200 GPa.

In another aspect, the electrodes have a Young's modulus of at least 250 GPa.

In another aspect, the electrodes have a Young's modulus of at least 300 GPa.

In another aspect, the electrodes have a Young's modulus of at least 350 GPa.

In another aspect, the electrodes have an electrical resistivity that is lower than the electrical resistivity of the metallic glass sample by a factor of at least 4.

In another aspect, the electrodes have an electrical resistivity that is lower than the electrical resistivity of the metallic glass sample by a factor of at least 5.

In another aspect, the electrodes have an electrical resistivity of equal or less than 40 μΩ·cm.

In another aspect, the electrodes have an electrical resistivity of equal or less than 30 μΩ·cm.

In another aspect, the electrodes have an electrical resistivity of equal or less than 20 μΩ·cm.

In another aspect, the electrodes comprise a refractory metal.

In another aspect, the electrodes comprise a metal selected from W, Mo, Re, Nb, and Ta.

In another aspect, the electrodes comprise a metal selected from W and Mo.

In another aspect, the electrodes comprise W.

In another aspect, the electrodes comprise a refractory metal alloy.

In another aspect, the electrodes comprise a metal alloy that comprises a metal selected from W, Mo, Re, Nb, and Ta.

In another aspect, the combined concentration of W, Mo, Re, Nb, and Ta in the alloy is at least 25%.

In another aspect, the combined concentration of W, Mo, Re, Nb, and Ta in the alloy is at least 50%.

In another aspect, the combined concentration of W, Mo, Re, Nb, and Ta in the alloy is at least 75%.

In another aspect, the electrodes comprise a metal alloy that comprises a metal selected from W and Mo.

In another aspect, the combined concentration of W and Mo in the alloy is at least 25%.

In another aspect, the combined concentration of W and Mo in the alloy is at least 50%.

In another aspect, the combined concentration of W and Mo in the alloy is at least 75%.

In another aspect, the electrodes comprise a metal alloy that comprises W.

In another aspect, the combined concentration of W in the alloy is at least 20%.

In another aspect, the combined concentration of W in the alloy is at least 50%.

In another aspect, the combined concentration of W in the alloy is at least 75%.

In another aspect, the electrical contact resistance at the contact interface between the electrodes and the metallic glass sample is less than 1 mΩ.

In another aspect, the electrodes are configured to apply a contact pressure at the contact interface between the electrodes and the metallic glass sample, and where the electrical contact resistance at the contact interface between the electrodes and the metallic glass sample is less than 1 mΩ.

In another aspect, the electrical contact resistance at the contact interface between the electrodes and the metallic glass sample is less than 0.5 mΩ.

In another aspect, the electrodes are configured to apply a contact pressure at the contact interface between the electrodes and the metallic glass sample, and where the electrical contact resistance at the contact interface between the electrodes and the metallic glass sample is less than 0.5 mΩ when the contact pressure is at least 100 MPa.

In another aspect, the electrical contact resistance is less than 0.4 mΩ when the contact pressure is at least 200 MPa.

In another aspect, the electrodes are configured to apply a contact pressure at the contact interface between the electrodes and the metallic glass sample, and where the electrical contact resistance at the contact interface between the electrodes and the metallic glass sample increases by less than 50% every time the contact pressure is released and then reapplied.

In another aspect, a method is provided for rapidly heating and shaping a metallic glass using a rapid discharge heating and forming apparatus. The method may include establishing contact at the interface between at least two electrodes and the sample of metallic glass by applying a contact pressure. The method may also include discharging a quantum of electrical energy through the sample to heat the sample to a processing temperature between the glass transition temperature of the metallic glass and the equilibrium melting point of the metallic glass forming alloy. The method may further include applying a deformational force to shape the heated sample into an article. The method may also include cooling the article to a temperature below the glass transition temperature of the metallic glass to form a metallic glass article. The at least two electrodes have a yield strength of at least 200 MPa, a Young's modulus that is at least 25% higher than the Young's modulus of the sample of metallic glass, and an electrical resistivity that is lower than the electrical resistivity of the sample of metallic glass by a factor of at least 3.

Additional aspects and features are set forth in part in the description that follows, and will become apparent to those skilled in the art upon examination of the specification or may be learned by the practice of the disclosed subject matter. A further understanding of the nature and advantages of the disclosure may be realized by reference to the remaining portions of the specification and the drawings, which forms a part of this disclosure.

DETAILED DESCRIPTION

In the RDHF process, it is important to limit the total electrical resistance of the RDHF system, as the efficiency of the heating cycle is determined by the ratio of the metallic glass sample resistance to the total system resistance. As such, the lower the total system resistance compared to the metallic glass sample resistance, the larger the efficiency of the heating cycle. One of the contributors to the total electrical resistance is the contact resistance at the electrode/sample interface. It is therefore important to promote good electrical contact between sample and electrode, thereby minimizing the interface contact resistance of the interface.

U.S. Pat. No. 8,613,813 discloses a concept according to which electrical contact at the interface is established between the metallic glass and electrodes made of a highly conductive metal with a low yield strength. The low yield strength electrode is pressed against the stronger metallic glass sample in a manner that causes the electrode contact surface to plastically deform around existing asperities in the metallic glass contact surface such that good electrical contact is promoted.

TABLE 1

Electrical resistivity, yield strength, and Young's modulus of various metals.

| Material | Electrical Resistivity [μΩ · cm] | Yield Strength [MPa] | Young's Modulus [GPa] |
|---|---|---|---|
| Silver | 1.6 | 55 | 76 |
| Copper | 1.7 | 33 | 110 |
| Nickel | 6.4 | 59 | 207 |
| Niobium | 15.1 | 207 | 103 |
| Tantalum | 12.5 | 220 | 186 |
| Molybdenum | 5.7 | 415 | 330 |
| Tungsten | 5.7 | 750 | 400 |
| Rhenium | 19.3 | 290 | 469 |

In various embodiments, U.S. Pat. No. 8,613,813 is directed to electrodes comprising silver, copper, or nickel, or alloys formed with at least 95 at % of silver, copper, or nickel. The electrical resistivity and yield strength of silver, copper, or nickel are presented in Table 1 (data taken from www.matweb.com and www.matbase.com). As seen, the electrical resistivity is in the range of 1-2 μΩ·cm for silver and copper and just over 6 μΩ·cm for nickel. The yield strength is between 55 and 60 MPa for nickel and silver, and just over 30 MPa for copper. Applied pressures in RDHF injection molding operations are typically in the range of 100-500 MPa. Hence the yield strength of these metals is substantially below typical RDHF pressures. As such, these metals can be expected to plastically deform substantially during a typical RDHF cycle. Therefore, silver, copper and nickel, having very low electrical resistivity and very low yield strength, are consistent with the concept introduced in U.S. Pat. No. 8,613,813. Lastly, the Young's modulus of these metals is relatively low. As listed in Table 1, the Young's modulus of silver and copper is 76 and 110 GPa, respectively, while that of nickel is just over 200 GPa.

The concept introduced in U.S. Pat. No. 8,613,813 of using such soft and highly conductive metals may result in relatively good electrical contact and relatively low interfacial resistance. However, the very low yield strength of these metals may limit the mechanical stability and overall lifecycle of the electrodes. Specifically, the very low yield strength may cause buckling of the electrode, increasing the risk of arcing at the electrode/sample contact, which may cause tool and/or feedstock damage or lead to a failed shot. The very low yield strength may also lead to rapid wear and a short lifecycle of the electrodes, which may increase the tooling cost per cycle.

In the disclosure, a different concept for establishing electrical contact at the interface is introduced. The disclosure provides for the use of stronger (i.e. having higher yield strength) and stiffer (i.e. having higher Young's modulus) electrodes with improved mechanical stability and longer lifecycle. Specifically, the disclosure is directed to electrodes made of a strong metal. Compared to the metallic glass sample, the electrode is stiffer and has substantially lower electrical resistivity. When the strong and stiff electrodes, in accordance with embodiments, are pressed against the strong but less stiff metallic glass sample, the metallic glass contact surface deforms elastically around existing asperities in the electrode contact surface such that good electrical contact is promoted. This concept, where electrical contact with the metallic glass sample is established through elastic deformation of the metallic glass sample at the interface, is essentially opposite of the concept introduced in U.S. Pat. No. 8,613,813, where electrical contact was established through plastic deformation of the electrode at the interface.

In some embodiments, the electrodes are made of a metal having a yield strength sufficiently high such that they resist plastic deformation at the contact interface between the electrodes and the metallic glass sample. In one embodiment, the electrodes have a yield strength of at least 200 MPa. In another embodiment, the electrodes have a yield strength of at least 300 MPa. In another embodiment, the electrodes have a yield strength of at least 400 MPa. In another embodiment, the electrodes have a yield strength of at least 500 MPa. In other embodiments, electrodes are made of metals having yield strength that is higher than the pressure applied at the contact interface between the electrodes and the metallic glass sample.

In some embodiments, the electrodes are made of a metal having a higher Young's modulus than the metallic glass sample. As such, under a certain pressure at the contact interface, the metallic glass sample may elastically deform more than the electrode at the interface because of the higher Young's modulus of the electrode (provided that the electrode yield strength is high enough such that the electrode does not substantially deform plastically at the interface). Therefore, in one embodiment, the Young's modulus of the electrode is at least 25% higher than the Young's modulus of the metallic glass sample. In another embodiment, the Young's modulus of the electrode is at least 50% higher than the Young's modulus of the metallic glass sample. In yet another embodiment, the Young's modulus of the electrode is at least 100 GPa. In another embodiment, the Young's modulus of the electrode is at least 75% higher than the Young's modulus of the metallic glass sample. In another embodiment, the Young's modulus of the electrode is at least 100% higher than the Young's modulus of the metallic glass sample. In yet another embodiment, the Young's modulus of the electrode is at least 150 GPa. In yet another embodiment, the Young's modulus of the electrode is at least 200 GPa. In yet another embodiment, the Young's modulus of the electrode is at least 250 GPa. In yet another embodiment, the Young's modulus of the electrode is at least 300 GPa. In yet another embodiment, the Young's modulus of the electrode is at least 350 GPa.

In some embodiments, the electrodes are made of a metal having an electrical resistivity that is substantially lower than the electrical resistivity of the metallic glass. As such, the total resistance of the RDHF apparatus (including the metallic glass sample) is not much higher than the resistance of the metallic glass sample, thus yielding a relatively high efficiency of the RCDF process, where the RCDF efficiency is defined as the ratio of the resistance of the metallic glass sample to the total resistance of the RDHF apparatus (including the metallic glass sample). In one embodiment, the electrodes have an electrical resistivity that is lower than the electrical resistivity of the metallic glass sample by a factor of at least 3. In another embodiment, the electrodes have an electrical resistivity that is lower than the electrical resistivity of the metallic glass sample by a factor of at least 4. In another embodiment, the electrodes have an electrical resistivity that is lower than the electrical resistivity of the metallic glass sample by a factor of at least 5. In yet another embodiment, the electrodes have an electrical resistivity of not more than 40 μΩ·cm. In yet another embodiment, the electrodes have an electrical resistivity of not more than 30 μΩ·cm. In yet another embodiment, the electrodes have an electrical resistivity of not more than 20 μΩ·cm.

One class of materials that may satisfy these criteria are refractory metals. The group of refractory metals includes Nb and Mo from the fifth period and Ta, W, and Re from the sixth period. Refractory metals are generally considerably stronger than Ag, Cu, and Ni, and are generally stiffer than metallic glasses. While the electrical resistivity of refractory metals is not as low as that of Ag, Cu, and Ni, it is generally considerably lower than the electrical resistivity of metallic glasses. As such, the electrical resistivity of refractory metals may be adequately low to yield relatively high RCDF efficiencies.

The electrical resistivity, yield strength, and Young's modulus of refractory metals niobium, tantalum, molybdenum, tungsten, and rhenium are presented in Table 1 (data taken from www.matweb.com and www.matbase.com). As seen, the electrical resistivity is under 6 μΩ·cm for tungsten and molybdenum, and under 20 μΩ·cm for niobium, tantalum, and rhenium. These electrical resistivity values are not as low as the values for silver and cooper, while the electrical resistivity values for molybdenum and tungsten are comparable to that of nickel. However, the yield strength of refractory metals is significantly higher than that of silver, copper, and nickel. Specifically, the yield strength of niobium, tantalum, and rhenium ranges between 200 MPa and 300 MPa, while that of molybdenum is 450 MPa and that of tungsten is 750 MPa. These yield strengths suggest that compared to silver, copper, and Nickel, refractory metals are more capable to resist yielding during typical contact pressures in the RDHF process, which typically range between 100 MPa and 500 MPa. The Young's modulus of niobium and tantalum refractory metals of 103 GPa and 186 GPa respectively are higher than that of silver but roughly on par with that of copper and nickel, respectively. However, the Young's modulus of molybdenum, tungsten, and rhenium ranging between 330 GPa and 470 GPa are significantly higher than that of copper and nickel.

A comparison between the refractory metals properties and the metallic glass properties is also important. Electrical resistivity, yield strength, and Young's modulus of metallic glasses $Pd_{40}Ni_{10}Cu_{30}P_{20}$, $Zr_{52.5}Ti_5Cu_{17.9}Ni_{14.6}Al_{10}$, and $Ni_{68.17}Cr_{8.65}Nb_{2.98}P_{16.42}B_{3.28}Si_{0.5}$ are presented in Table 2 (Data for $Pd_{40}Ni_{10}Cu_{30}P_{20}$ and $Zr_{52.5}Ti_5Cu_{17.9}Ni_{14.6}Al_{10}$ taken from W. L. Jonson and K. Samwer, Physical Review Letters 95, 195501 (2005) and N. Mattern et al. Journal of Non-Crystalline Solids 345&346, 758-761 (2004), the disclosures of which are incorporated herein by reference). The yield strength of metallic glasses is very high, ranging between 1400 and 2400 MPa, suggesting that a metallic glass feedstock would be capable of resisting plastic deformation under typical contact pressures applied during the RDHF process, typically ranging between 100-500 MPa.

The electrical resistivity of metallic glasses is also very high, ranging between 140 and 150 μΩ·cm, which is considerably higher compared to that of refractory metals (e.g. between 5 and 20 μΩ·cm). The electrical resistivity of refractory metals is thus smaller than that of metallic glasses by a factor of at least 3. The low electrical resistivity of refractory metals compared to that of metallic glasses suggests that the resistance of refractory metal electrodes would be considerably smaller than the resistance of the metallic glass feedstock (especially when the electrodes and sample generally have approximately the same diameter while the electrodes are typically at least as long as the sample). As such, refractory metal electrodes are expected to yield adequately high RDHF efficiencies.

Lastly, the Young's modulus of metallic glasses is relatively low when compared to that of refractory metals. Specifically, the Young's modulus of metallic glasses ranges between 89 GPa and 137 GPa, while that of refractory metals between 103 GPa and 469 GPa. With the exception of niobium/$Ni_{68.17}Cr_{8.65}Nb_{2.98}P_{16.42}B_{3.28}Si_{0.5}$ pair, in every other refractory metal/metallic glass pair the Young's modulus of the refractory metal is considerably higher than that of the metallic glass. Therefore, in such pairs where the Young's modulus of the electrode substantially exceeds that of the metallic glass sample, the metallic glass sample would elastically deform more than the electrode at the electrode/sample contact interface under a given contact pressure, assuming that neither the electrode nor the sample substantially deform plastically at the interface. This tendency allows for the establishment of good electrical contact at the electrode/sample interface, consistent with the general concept introduced herein.

TABLE 2

Electrical resistivity, yield strength, and Young's modulus of various metallic glasses.

| Material | Electrical Resistivity [μΩ · cm] | Yield Strength [MPa] | Young's Modulus [GPa] |
|---|---|---|---|
| $Pd_{40}Ni_{10}Cu_{30}P_{20}$ | 150 | 1720 | 92 |
| $Zr_{52.5}Ti_5Cu_{17.9}Ni_{14.6}Al_{10}$ | 140 | 1630 | 85 |
| $Ni_{68.17}Cr_{8.65}Nb_{2.98}P_{16.42}B_{3.28}Si_{0.5}$ | 152 | 2400 | 137 |

EXAMPLES

Embodiments disclosed herein are tested for the cases of a fairly stiff and a fairly compliant metallic glass, $Ni_{68.17}Cr_{8.65}Nb_{2.98}P_{16.42}B_{3.28}Si_{0.5}$ and $Zr_{52.5}Ti_5Cu_{17.9}N_{14.6}Al_{10}$, having Young's moduli of 135 GPa and 85 GPa, respectively. In both cases, the electrical contact resistances produced when these metallic glasses are paired with a tungsten electrode are compared to the cases where the metallic glasses are paired with a copper electrode.

This comparison would be more effective in the cases where the metallic glass sample has a low Young's modulus, as in $Zr_{52.5}Ti_5Cu_{17.9}Ni_{14.6}Al_{10}$ metallic glass. This is because a low modulus would allow more elastic deformation of the metallic glass around asperities at the contact interface. However, as shown below, this concept is sufficiently effective in the cases even when the metallic glass sample has a high Young's modulus, such as in the $Ni_{68.17}Cr_{8.65}Nb_{2.98}P_{16.42}B_{3.28}Si_{0.5}$ metallic glass, because the electrical contact resistances are adequately low at the contact pressures of interest.

The effect of cyclic loading cycles on the electrical contact resistance is investigated to determine how much the electrical contact resistance increases with repeated use of the electrodes. Comparison is made between tungsten and copper electrodes.

Example 1. Electrical Contact Resistance in Tungsten Electrode/Ni-based Metallic Glass and Copper Electrode/Ni-based Metallic Glass Pairs FIG. 1 presents a plot of the electrical contact resistance vs contact pressure for an RCFD loading cycle of a tungsten electrode/$Ni_{68.17}Cr_{8.65}Nb_{2.98}P_{16.42}B_{3.28}Si_{0.5}$ metallic glass pair and a loading cycle of a copper electrode/$Ni_{68.17}Cr_{8.65}Nb_{2.98}P_{16.42}B_{3.28}Si_{0.5}$ metallic glass pair. In the copper electrode/$Ni_{68.17}Cr_{8.65}Nb_{2.98}P_{16.42}B_{3.28}Si_{0.5}$ metallic glass pair, contact pressures up to 228 MPa were applied, as higher pressures resulted in complete failure of the copper electrode. On the other hand, in the tungsten electrode/$Ni_{68.17}Cr_{8.65}Nb_{2.98}P_{16.42}B_{3.28}Si_{0.5}$ metallic glass pair, contact pressures up to 433 MPa were applied, though this value is not the limit of failure of the tungsten electrode.

The copper/$Ni_{68.17}Cr_{8.65}Nb_{2.98}P_{16.42}B_{3.28}Si_{0.5}$ loop shows that as the copper/$Ni_{68.17}Cr_{8.65}Nb_{2.98}P_{16.42}B_{3.28}Si_{0.5}$ pair is loaded, the electrical contact resistance drops from the value of 0.29 mΩ associated with a contact pressure of 0 MPa to 0.14 mΩ associated with a contact pressure of 228 MPa. When the load is reversed, the contact resistance increases back to 0.29 mΩ as the contact pressure is reduced to 0 MPa. On the other hand, the tungsten/$Ni_{68.17}Cr_{8.65}Nb_{2.98}P_{16.42}B_{3.28}Si_{0.5}$ loop shows that as the tungsten electrode/$Ni_{68.17}Cr_{8.65}Nb_{2.98}P_{16.42}B_{3.28}Si_{0.5}$ metallic glass pair is loaded, the electrical contact resistance drops from the value of 0.42 mΩ associated with a contact pressure of 0 MPa to 0.15 mΩ associated with a contact pressure of 433 MPa. When the load is reversed, the contact resistance increases back to 0.42 mΩ as the contact pressure is reduced to 0 MPa.

Even though at 0 MPa the electrical contact resistance is about 50% higher for the tungsten electrode/$Ni_{68.17}Cr_{8.65}Nb_{2.98}P_{16.42}B_{3.28}Si_{0.5}$ metallic glass pair compared to the copper electrode/$Ni_{68.17}Cr_{8.65}Nb_{2.98}P_{16.42}B_{3.28}Si_{0.5}$ metallic glass pair, in the useful RDHF range of 100 to 500 MPa, the electrical contact resistance is closer between the two pairs. Specifically, at contact pressures greater than 200 MPa the electrical contact resistance of the tungsten electrode/$Ni_{68.17}Cr_{8.65}Nb_{2.98}P_{16.42}B_{3.28}Si_{0.5}$ metallic glass pair is similar to that of copper electrode/$Ni_{68.17}Cr_{8.65}Nb_{2.98}P_{16.42}B_{3.28}Si_{0.5}$ metallic glass pair. It can therefore be concluded that the contact resistance of the tungsten electrode/$Ni_{68.17}Cr_{8.65}Nb_{2.98}P_{16.42}B_{3.28}Si_{0.5}$ metallic glass pair is adequately low for RDHF processing.

Figure 2:
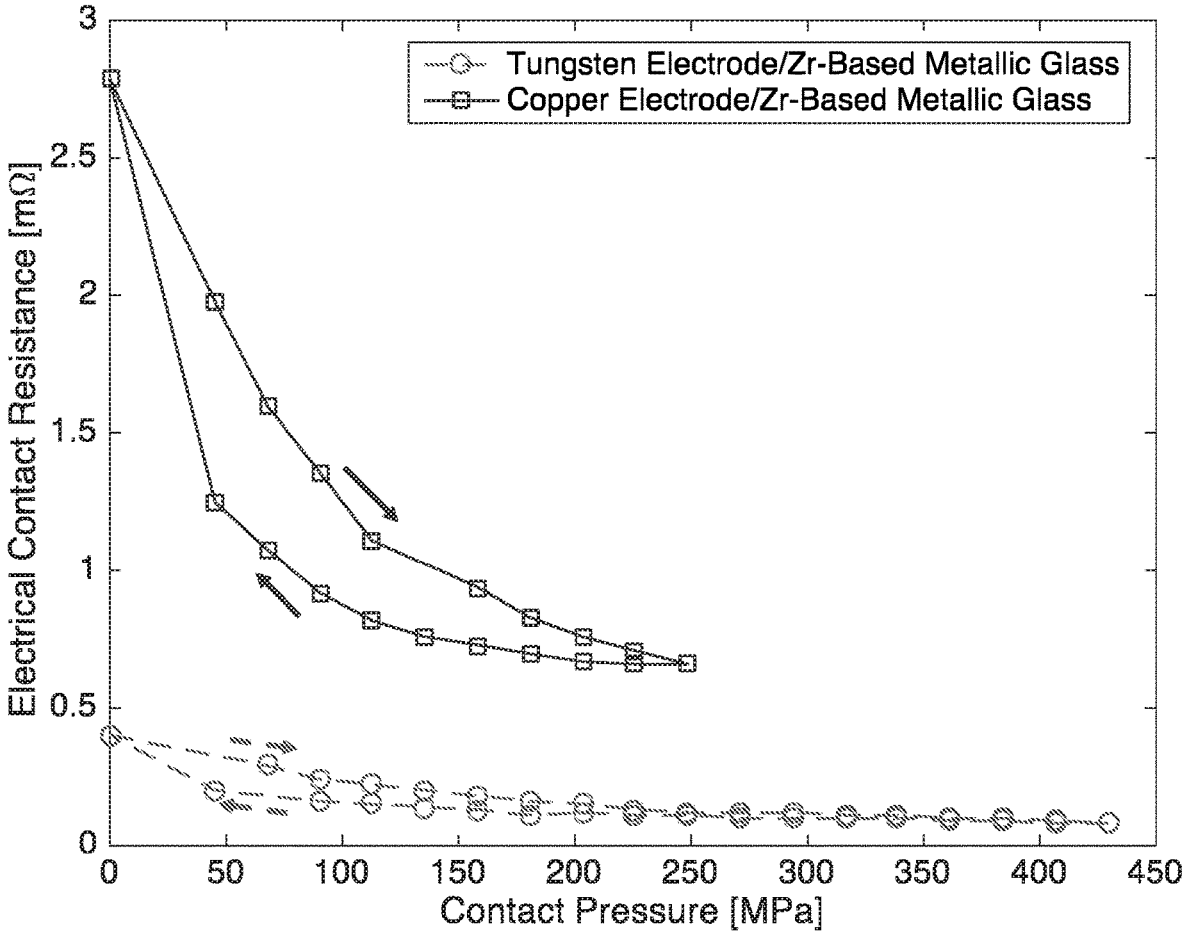
FIG. 2 presents a plot of the electrical contact resistance vs. contact pressure for an RCDF loading cycle of a tungsten electrode/$Zr_{52.5}Ti_5Cu_{17.9}Ni_{14.6}Al_{10}$ metallic glass pair and a loading cycle of a copper electrode/$Zr_{52.5}Ti_5Cu_{17.9}Ni_{14.6}Al_{10}$ metallic glass pair in accordance with embodiments of the disclosure.

Example 2. Electrical Contact Resistance in Tungsten Electrode/Zr-based Metallic Glass and Copper Electrode/Zr-based Metallic Glass Pairs FIG. 2 presents a plot of the electrical contact resistance vs contact pressure for an RCDF loading cycle of a tungsten electrode/$Zr_{52.5}Ti_5Cu_{17.9}Ni_{14.6}Al_{10}$ metallic glass pair and an RCDF loading cycle of a copper electrode/$Zr_{52.5}Ti_5Cu_{17.9}Ni_{14.6}Al_{10}$ metallic glass pair. In the copper electrode/$Zr_{52.5}Ti_5Cu_{17.9}Ni_{14.6}Al_{10}$ metallic glass pair, contact pressures up to 249 MPa were applied, as higher pressures resulted in complete failure of the copper electrode. On the other hand, in the tungsten electrode/$Zr_{52.5}Ti_5Cu_{17.9}Ni_{14.6}Al_{10}$ metallic glass pair, contact pressures up to 430 MPa were applied, though this value is not the limit of failure of the tungsten electrode.

The copper/$Zr_{52.5}Ti_5Cu_{17.9}N_{14.6}Al_{10}$ loop shows that as the copper electrode/$Zr_{52.5}Ti_5Cu_{17.9}N_{14.6}Al_{10}$ metallic glass pair is loaded, the electrical contact resistance drops from the value of 2.78 mΩ associated with a contact pressure of 0 MPa to 0.66 mΩ associated with a contact pressure of 249 MPa. When the load is reversed, the contact resistance increases back to 2.78 mΩ as the contact pressure is reduced to 0 MPa. On the other hand, the tungsten/$Zr_{52.5}Ti_5Cu_{17.9}Ni_{14.6}Al_{10}$ loop shows that as the tungsten electrode/$Zr_{52.5}Ti_5Cu_{17.9}N_{14.6}Al_{10}$ metallic glass pair is loaded, the electrical contact resistance drops from the value of 0.4 mΩ associated with a contact pressure of 0 MPa to 0.08 mΩ associated with a contact pressure of 430 MPa. When the load is reversed, the contact resistance increases back to 0.4 mΩ as the contact pressure is reduced to 0 MPa.

Compared to the case of a stiffer metallic glass sample (e.g. $Ni_{68.17}Cr_{8.65}Nb_{2.98}P_{16.42}B_{3.28}Si_{0.5}$ having a Young's modulus of 135 GPa), in the case of a more compliant metallic glass sample (e.g. $Zr_{52.5}Ti_5Cu_{17.9}Ni_{14.6}Al_{10}$ having a Young's modulus of 85 GPa) the present concept is more effective. Specifically, at a high contact pressure of about 430 MPa the electrical contact resistance in the tungsten electrode/$Zr_{52.5}Ti_5Cu_{17.9}N_{14.6}Al_{10}$ metallic glass pair is roughly 50% the value in the tungsten electrode/$Ni_{68.17}Cr_{8.65}Nb_{2.98}P_{16.42}B_{3.28}Si_{0.5}$ metallic glass pair.

Moreover, unlike the case of a stiffer metallic glass sample, a tungsten electrode in the case of a more compliant metallic glass sample is more efficient than a copper electrode. Specifically, at a contact pressure of 0 MPa, the electrical contact resistance in the copper electrode/$Zr_{52.5}Ti_5Cu_{17.9}Ni_{14.6}Al_{10}$ metallic glass pair is roughly 7 times higher than the electrical contact resistance in the tungsten electrode/$Zr_{52.5}Ti_5Cu_{17.9}N_{14.6}Al_{10}$ metallic glass pair, while at a contact pressure of about 250 MPa, the electrical contact resistance in the copper electrode/$Zr_{52.5}Ti_5Cu_{17.9}Ni_{14.6}Al_{10}$ metallic glass pair is roughly 6 times higher than the electrical contact resistance in the tungsten electrode/$Zr_{52.5}Ti_5Cu_{17.9}N_{14.6}Al_{10}$ metallic glass pair.

Figure 3:
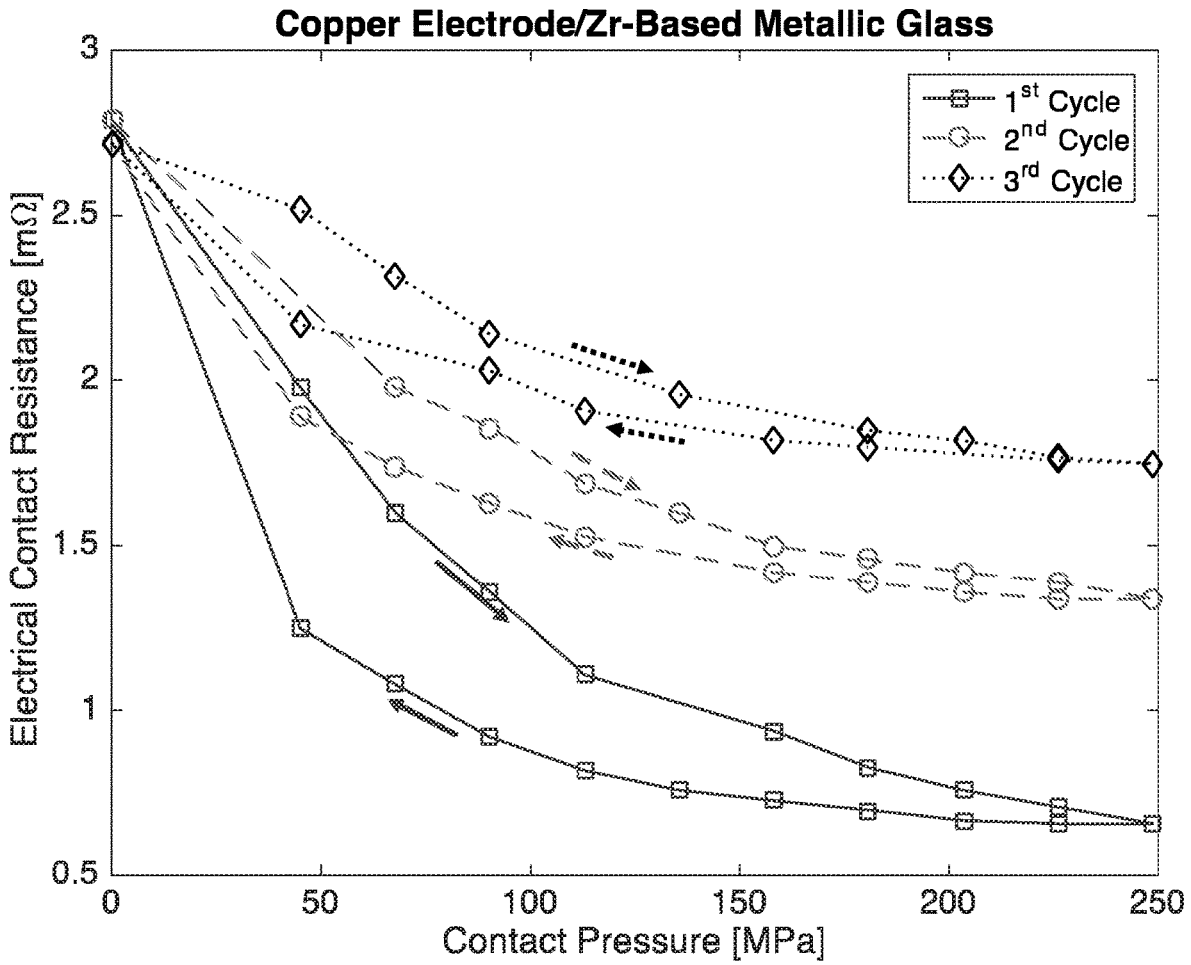
FIG. 3 presents a plot of the electrical contact resistance vs. contact pressure for multiple RCDF loading cycles of a copper electrode/$Zr_{52.5}Ti_5Cu_{17.9}Ni_{14.6}Al_{10}$ metallic glass pair in accordance with embodiments of the disclosure.

Example 3. Effect of a Cyclic Loading in a Copper Electrode/Zr-based Metallic Glass Pair FIG. 3 presents a plot of the electrical contact resistance vs. contact pressure for multiple RCDF loading cycles of a copper electrode/$Zr_{52.5}Ti_5Cu_{17.9}Ni_{14.6}Al_{10}$ metallic glass pair. In the first cycle, the electrical contact resistance drops from the value of about 2.8 mΩ associated with a contact pressure of 0 MPa to 0.66 mΩ associated with a contact pressure of 249 MPa. When the load is reversed, the contact resistance increases back to about 2.8 mΩ as the contact pressure is reduced to 0 MPa. In the second cycle, the electrical contact resistance drops from the value of about 2.8 mΩ associated with a contact pressure of 0 MPa to 1.34 mΩ associated with a contact pressure of 249 MPa. When the load is reversed, the contact resistance increases back to about 2.8 mΩ as the contact pressure is reduced to 0 MPa. In the third cycle, the electrical contact resistance drops from the value of about 2.8 mΩ associated with a contact pressure of 0 MPa to 1.75 mΩ associated with a contact pressure of 249 MPa. When the load is reversed, the contact resistance increases back to about 2.8 mΩ as the contact pressure is reduced to 0 MPa.

Therefore, in a copper electrode/$Zr_{52.5}Ti_5Cu_{17.9}Ni_{14.6}Al_{10}$ metallic glass pair loaded at a contact pressure of 249 MPa, the electrical contact resistance in the second cycle increases by about 0.7 mΩ, or about 100%, while in the second cycle the electrical contact resistance increases further by about 0.4 mΩ, or about 30%.

Figure 4:
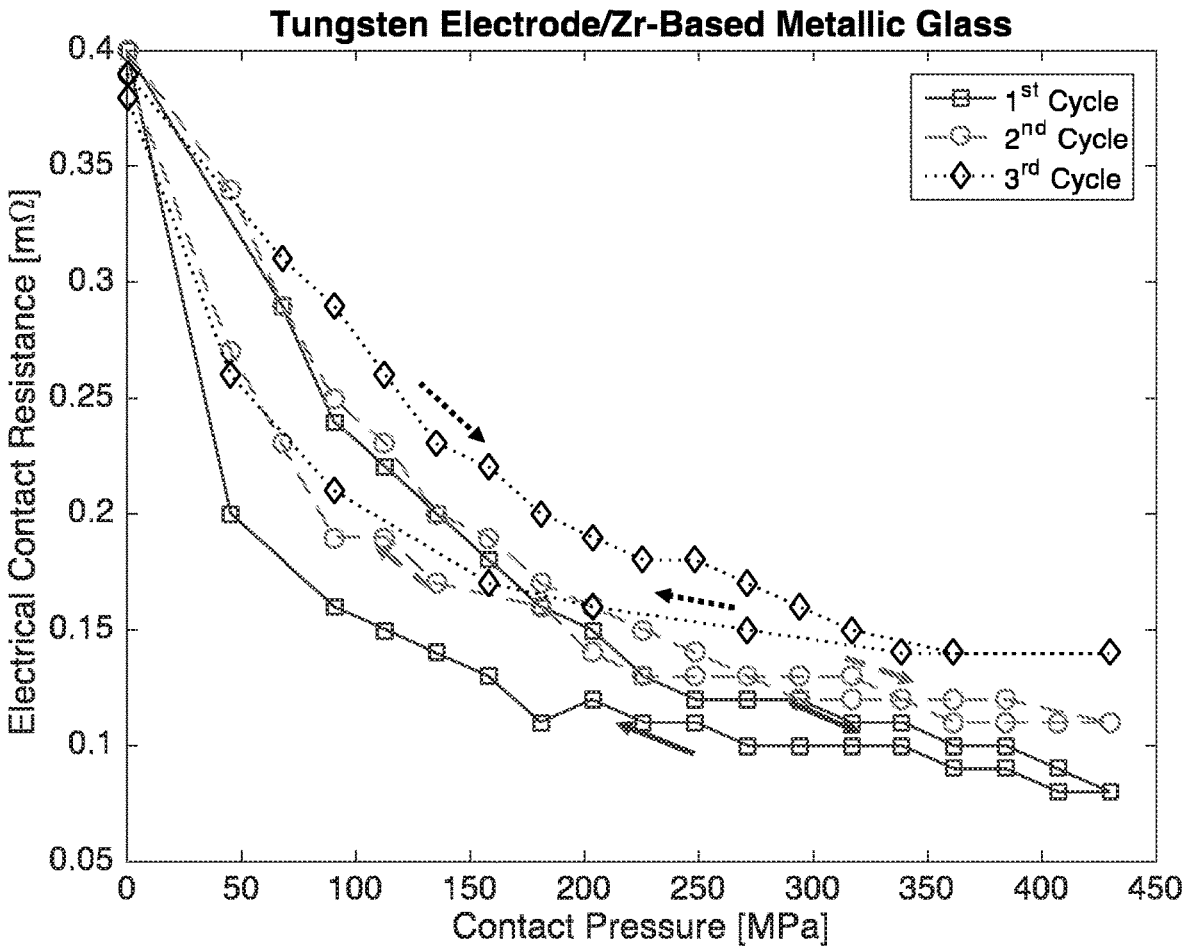
FIG. 4 presents a plot of the electrical contact resistance vs. contact pressure for multiple RCDF loading cycles of a tungsten electrode/$Zr_{52.5}Ti_5Cu_{17.9}Ni_{14.6}Al_{10}$ metallic glass pair in accordance with embodiments of the disclosure.

Example 4. Effect of a Cyclic Loading in a Tungsten Electrode/Zr-based Metallic Glass Pair FIG. 4 presents a plot of the electrical contact resistance vs. contact pressure for multiple RCDF loading cycles of a tungsten electrode/$Zr_{52.5}Ti_5Cu_{17.9}Ni_{14.6}Al_{10}$ metallic glass pair. In the first cycle, the electrical contact resistance drops from the value of 0.4 mΩ associated with a contact pressure of 0 MPa to 0.08 mΩ associated with a contact pressure of 430 MPa. When the load is reversed, the contact resistance increases back to about 0.4 mΩ as the contact pressure is reduced to 0 MPa. In the second cycle, the electrical contact resistance drops from the value of about 0.4 mΩ associated with a contact pressure of 0 MPa to 0.11 mΩ associated with a contact pressure of 430 MPa. When the load is reversed, the contact resistance increases back to about 0.4 mΩ as the contact pressure is reduced to 0 MPa. In the third cycle, the electrical contact resistance drops from the value of about 0.4 mΩ associated with a contact pressure of 0 MPa to 0.14 mΩ associated with a contact pressure of 430 MPa. When the load is reversed, the contact resistance increases back to about 0.4 mΩ as the contact pressure is reduced to 0 MPa.

Therefore, in a tungsten electrode/$Zr_{52.5}Ti_5Cu_{17.9}Ni_{14.6}Al_{10}$ metallic glass pair loaded at a contact pressure of 430 MPa, the electrical contact resistance in the second cycle increases by about 0.03 mΩ, or about 38%, while in the second cycle the electrical contact resistance increases further by about 0.3 mΩ, or about 27%.

Hence, according to embodiments of the disclosure where the electrodes are configured to apply a contact pressure at the contact interface between the electrodes and the metallic glass sample, the electrical contact resistance at the contact interface between the electrodes and the metallic glass sample increases by less than 50% every time the contact pressure is released and then reapplied.

In various embodiments, the electrical contact resistance at the contact interface between the electrodes and the metallic glass sample is less than 1 mΩ. In one embodiment, the electrical contact resistance at the contact interface between the electrodes and the metallic glass sample is less than 0.5 mΩ. In another embodiment, the electrical contact resistance at the contact interface between the electrodes and the metallic glass sample is less than 0.4 mΩ. In another embodiment, the electrical contact resistance at the contact interface between the electrodes and the metallic glass sample is less than 0.3 mΩ. In another embodiment, the electrical contact resistance at the contact between the electrodes and the metallic glass sample is less than 0.2 mΩ. In another embodiment, the electrical contact resistance at the contact interface between the electrodes and the metallic glass sample is less than 0.1 mΩ.

In other embodiments, the electrodes are configured to apply a contact pressure at the contact interface between the electrodes and the metallic glass sample, and where the electrical contact resistance at the contact interface between the electrodes and the metallic glass sample is less than 0.5 mΩ when the contact pressure is at least 100 MPa. In one embodiment, the electrical contact resistance is less than 0.4 mΩ when the contact pressure is at least 100 MPa. In another embodiment, the electrical contact resistance is less than 0.3 mΩ when the contact pressure is at least 100 MPa. In another embodiment, the electrical contact resistance is less than 0.2 mΩ when the contact pressure is at least 100 MPa. In one embodiment, the electrical contact resistance is less than 0.4 mΩ when the contact pressure is at least 200 MPa. In another embodiment, the electrical contact resistance is less than 0.3 mΩ when the contact pressure is at least 300 MPa. In another embodiment, the electrical contact resistance is less than 0.2 mΩ when the contact pressure is at least 400 MPa.

Method of Measuring the Electrical Contact Resistance vs. Contact Pressure

The contact resistance at the interface between an electrode and the metallic glass sample is measured using the four-point probe method. The metallic glass sample is a cylindrical rod having 5 mm in diameter with both ends ground plane-parallel, and is placed between two electrodes, which are also cylindrical rods with their contact ends ground plane-parallel. Copper leads connected to a DC power supply are attached to the electrodes away from the contacts with the metallic glass sample, and a current of 0.1 A generated by a DC power supply is passed through the electrodes and metallic glass sample. The voltage drop across one of the electrode/metallic glass sample contacts is measured using copper wires spot welded on the electrode and metallic glass sample in close proximity to the contact interface. The contact resistance across the interface is determined by dividing the measured voltage at the contact interface by the applied current. This contact resistance measurement is corrected by subtracting the individual resistances of the portions of the electrode and metallic glass sample situated between the voltage terminal at the spot weld and the contact interface. The resistance of the electrode portion is calculated by multiplying the electrode resistivity (taken from Table 1) by the length of the electrode situated between the voltage terminal and the contact interface and dividing by the cross-sectional area of the electrode. The resistance of the metallic glass sample portion is calculated by multiplying the metallic glass resistivity (taken from Table 2) by the length of the metallic glass sample situated between the voltage terminal and the contact interface and dividing by the cross-sectional area of the metallic glass sample. The resistance of the wire between the spot weld and the multimeter is neglected.

A pressure is applied at the contact interface using a pneumatic drive with a 5-inch diameter piston/cylinder. The pressure at the contact interface is calculated as the gas pressure in the pneumatic drive cylinder multiplied by the ratio of the cross-sectional area of the cylinder to the cross sectional area of the metallic glass sample.

During the application of pressure, the electrode/metallic glass sample assembly is supported by enclosing the assembly in a cylindrical aluminum barrel. A Kapton insulating film is placed between the barrel and the electrode/metallic glass sample assembly to electrically insulate the assembly from the barrel. Holes are drilled in the barrel and insulating film at the points of voltage measurement in order to allow the copper wires measuring voltage to directly attach to the electrode and metallic glass sample.

Rapid Discharge Heating and Forming (RDHF) Technique

Figure 5:
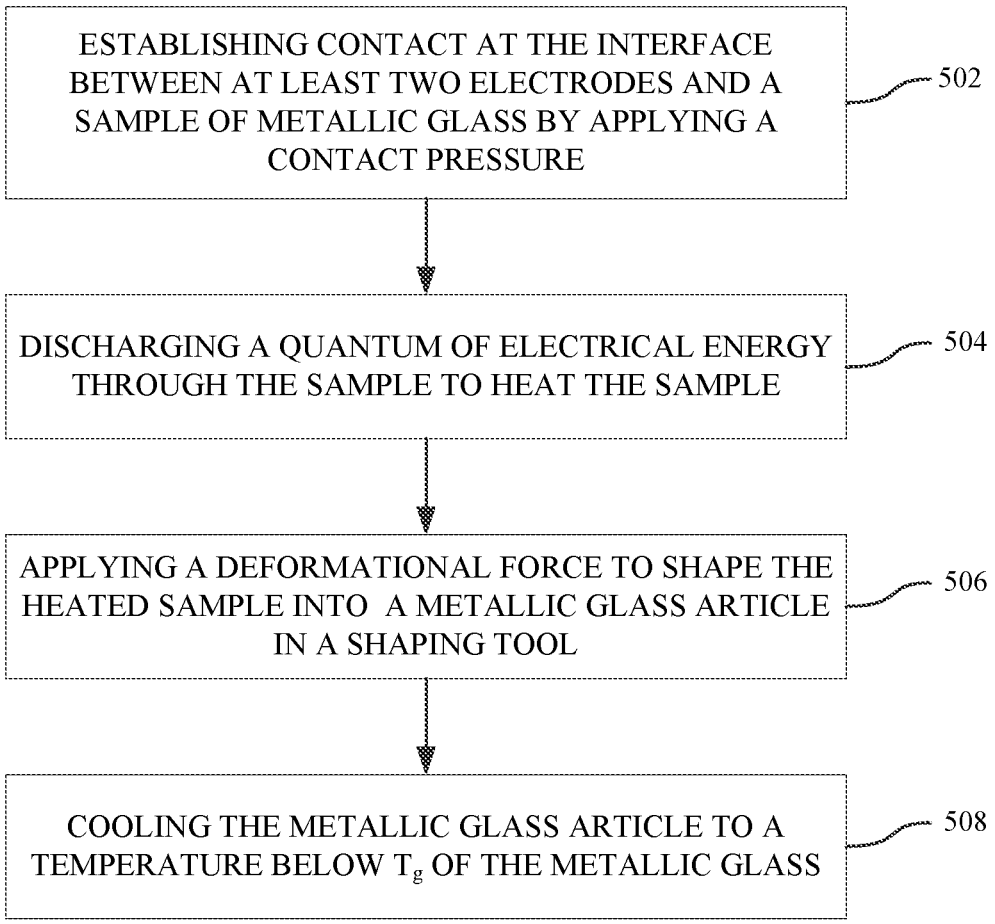
FIG. 5 is a flow chart of the RCDF technique in accordance with embodiments of the disclosure.

A flow chart of the RDHF technique in accordance with embodiments of the disclosure is provided in FIG. 5. At least two electrodes interconnect a source of electrical energy to a sample of metallic glass. The at least two electrodes have a yield strength of at least 200 MPa, a Young's modulus that is at least 25% higher than the Young's modulus of the sample of metallic glass, and an electrical resistivity that is lower than the electrical resistivity of the sample of metallic glass by a factor of at least 3. The process begins with establishing contact at the interface between the at least two electrodes and the sample of metallic glass at operation 502. In certain embodiments, contact at the interface between the electrodes and the sample of metallic glass may be established by applying a contact pressure. In some embodiments, the electrical contact resistance at the interface between the electrodes and the sample of metallic glass is less than 1 mΩ. In other embodiments, the electrical contact resistance at the interface between the electrodes and the sample of metallic glass is less than 0.5 mΩ when the contact pressure is at least 100 MPa.

The process also includes discharging a quantum of electrical energy through the metallic glass sample to heat the sample to a processing temperature between the glass transition temperature of the metallic glass and the equilibrium melting point of the metallic glass forming alloy at operation 504. In some embodiments, the electrical energy is between 100 J to 100 kJ. In some embodiments, the electrical energy is stored in a capacitor. The discharged electrical energy may rapidly and uniformly heat the metallic glass sample to a predetermined "processing temperature" above the glass transition temperature of the metallic glass. In some embodiments, the processing temperature may be about half-way between the glass transition temperature of the metallic glass and the equilibrium melting point of the metallic glass forming alloy. In other embodiments, the processing temperature may be about 200-300 K above the glass transition temperature of the metallic glass. In some embodiments, the processing temperature may be such that the metallic glass has a process viscosity sufficient to allow facile shaping. In other embodiments, the processing temperature may be such that the metallic glass has a process viscosity in the range of 1 to $10^4$ Pas-s. In some embodiments, the electrical energy is discharged on a time scale of 100 microseconds to 100 milliseconds. In other embodiments, the electrical energy is discharged on a time scale of 1 millisecond to 25 milliseconds.

Once the metallic glass sample is heated such that it has a sufficiently low process viscosity, the process further includes applying a deformational force to shape the heated sample into an article using a shaping tool at operation 506. The sample may be shaped into an article via any number of techniques (i.e. shaping tools) including, for example, injection molding, dynamic forging, stamp forging, blow molding, etc. However, the ability to shape a sample of metallic glass depends entirely on ensuring that the heating of the sample is both rapid and effectively uniform across the sample. In some instances, if effectively uniform heating is not achieved, then the sample may instead experience localized heating and, although such localized heating can be useful for some techniques, such as, for example, joining or spot-welding pieces together, or shaping specific regions of the sample, such localized heating has not and cannot be used to perform bulk shaping of a metallic glass sample. Likewise, if the sample heating is not sufficiently rapid (i.e. on the order of 500-$10^5$ K/s), either the material being formed will lose its amorphous structure by crystallizing, or the shaping technique will be limited to those amorphous materials having superior processability characteristics (i.e., high stability of the supercooled liquid against crystallization), again reducing the utility of the process.

The process further includes cooling the metallic glass article to a temperature below the glass transition temperature of the metallic glass to render the shaped article amorphous at operation 508.

The shaping tool and the RDHF apparatus has been disclosed in conjunction with a rapid capacitive discharge forming (RCDF) apparatus, such as in the following patents or patent applications: U.S. Pat. No. 8,613,813, entitled "Forming of metallic glass by rapid capacitor discharge;" U.S. Pat. No. 8,613,814, entitled "Forming of metallic glass by rapid capacitor discharge forging"; U.S. Pat. No. 8,613,815, entitled "Sheet forming of metallic glass by rapid capacitor discharge;" U.S. Pat. No. 8,613,816, entitled "Forming of ferromagnetic metallic glass by rapid capacitor discharge;" U.S. Pat. No. 9,297,058, entitled "Injection molding of metallic glass by rapid capacitor discharge;" and U.S. patent application Ser. No. 15/406,436, entitled "Feedback-assisted rapid discharge heating and forming of metallic glasses," each of which is incorporated by reference in its entirety.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

The invention claimed is:

1. A rapid discharge heating and forming apparatus comprising:

a source of electrical energy;

at least two electrodes configured to interconnect the source of electrical energy and configured to electrically connect a metallic glass sample to the source of electrical energy when the metallic glass sample is in contact with each of said electrode;

a shaping tool disposed configured to be in forming relation to the metallic glass sample when the metallic glass sample is electrically connected to the two electrodes; wherein the at least two electrodes have a yield strength of at least 200 MPa, a Young's modulus at least 100 GPa, and an electrical resistivity equal to or less than 40 μΩ·cm.

2. The apparatus of claim 1, wherein the electrodes comprise a refractory metal.

3. The apparatus of claim 2, wherein the electrodes comprise a metal selected from the group consisting of W, Mo, Re, Nb, and Ta.

4. A rapid discharge heating and forming apparatus comprising:

a source of electrical energy configured to deliver a quantum of electrical energy to heat a metallic glass sample;

at least two electrodes configured to interconnect the source of electrical energy to the metallic glass sample;

a shaping tool configured to be disposed in forming relation to the metallic glass sample and apply a deformational force to shape the heated sample to an article;

wherein the at least two electrodes have a yield strength of at least 200 MPa, a Young's modulus that is at least 25% higher than the metallic glass sample, and an electrical resistivity that is lower than the metallic glass sample by a factor of at least 3.

5. The apparatus of claim 4, wherein the electrodes have a Young's modulus of at least 100 GPa.

6. The apparatus of claim 4, wherein the electrodes have an electrical resistivity of equal to or less than 40 μΩ·cm.

7. The apparatus of claim 4, wherein the electrodes comprise a refractory metal.

8. The apparatus of claim 4, wherein the electrodes comprise a metal selected from the group consisting of W, Mo, Re, Nb, and Ta.

9. The apparatus of claim 4, wherein the electrodes are configured to apply a contact pressure at the contact interface between the electrodes and the metallic glass sample, and wherein the yield strength of the electrodes is higher than the applied contact pressure.

10. The apparatus of claim 4, wherein the electrodes have a Young's modulus that is at least 50% higher than the metallic glass sample.

11. The apparatus of claim 4, wherein the electrodes are configured to apply a contact pressure at the contact interface between the electrodes and the metallic glass sample, and wherein the electrical contact resistance at the contact interface between the electrodes and the metallic glass sample is less than 1 mΩ.

12. The apparatus of claim 4, wherein the electrodes are configured to apply a contact pressure of at least 100 MPa at the contact interface between the electrodes and the metallic glass sample, and wherein the electrical contact resistance at the contact interface between the electrodes and the metallic glass sample is less than 0.5 mΩ at the contact pressure.

13. The apparatus of claim 4, wherein the electrodes are configured to apply, release, and reapply a contact pressure at the contact interface between the electrodes and the metallic glass sample, and wherein the electrical contact resistance at the contact interface between the electrodes and the metallic glass sample increases by less than 50% when the contact pressure is released and then reapplied.

14. A method for rapidly heating and shaping a metallic glass using a rapid discharge heating and forming apparatus, the method comprising:

establishing contact at an interface between at least two electrodes and a sample of metallic glass by applying a contact pressure;

discharging a quantum of electrical energy from a source of electrical energy through the sample to heat the sample to a processing temperature between the glass transition temperature of the metallic glass and the equilibrium melting point of a metallic glass forming alloy capable of forming the metallic glass;

applying a deformational force in a shaping tool to shape the heated sample into an article; and cooling the article to a temperature below the glass transition temperature of the metallic glass to form a metallic glass article, wherein the at least two electrodes have a yield strength of at least 200 MPa, a Young's modulus that is at least 25% higher than the Young's modulus of the sample of metallic glass, and an electrical resistivity that is lower than the electrical resistivity of the sample of metallic glass by a factor of at least 3.

15. The method of claim 14, wherein the electrical contact resistance at the interface between the electrodes and the sample of metallic glass is less than 0.5 mΩ at the contact pressure of at least 100 MPa.

16. The method of claim 14, wherein the electrodes comprise a refractory metal.

17. The method of claim 14, wherein the electrodes comprise a metal selected from the group consisting of W, Mo, Re, Nb, and Ta.

18. The method of claim 14, wherein the electrodes have a Young's modulus of at least 100 GPa.

19. The method of claim 14, wherein the electrodes have an electrical resistivity of equal or less than 40 μΩ·cm.

* * * * *